US007553131B2

(12) United States Patent
Cunha et al.

(10) Patent No.: US 7,553,131 B2
(45) Date of Patent: Jun. 30, 2009

(54) INTEGRATED PLATFORM, TIP, AND MAIN BODY MICROCIRCUITS FOR TURBINE BLADES

(75) Inventors: Francisco J. Cunha, Avon, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 404 days.

(21) Appl. No.: 11/491,405

(22) Filed: Jul. 21, 2006

(65) Prior Publication Data

US 2008/0019841 A1 Jan. 24, 2008

(51) Int. Cl.
*F01D 5/18* (2006.01)

(52) U.S. Cl. ..... 416/92; 416/97 R; 416/193 A; 415/115

(58) Field of Classification Search ..... 415/115; 416/92, 96 R, 97 R, 193 A
See application file for complete search history.

(56) References Cited

U.S. PATENT DOCUMENTS 3,329,596 A * 7/1967 Abt et al. ..... 205/652
5,690,472 A * 11/1997 Lee ..... 416/97 R
5,813,835 A 9/1998 Corsmeier et al.
6,017,189 A * 1/2000 Judet et al. ..... 416/97 R
6,247,896 B1 * 6/2001 Auxier et al. ..... 416/97 R
6,705,831 B2 * 3/2004 Draper ..... 415/115
6,932,571 B2 * 8/2005 Cunha et al. ..... 416/97 R
2004/0197190 A1 10/2004 Stec et al.
2006/0056970 A1 3/2006 Jacala et al.

FOREIGN PATENT DOCUMENTS

EP 1561900 8/2005
EP 1586738 10/2005

* cited by examiner

*Primary Examiner*—Ninh H Nguyen
(74) *Attorney, Agent, or Firm*—Bachman & LaPointe, P.C. (P&W)

(57) ABSTRACT

A turbine engine component has an airfoil portion with a pressure side and a suction side. The turbine engine component further has a first cooling microcircuit for cooling the suction side of the airfoil portion. The first cooling microcircuit is embedded within a first wall forming the suction side. The first cooling microcircuit has a circuit for allowing a cooling fluid in the first cooling microcircuit to exit at a tip of the airfoil portion. The turbine engine component also has a second cooling microcircuit embedded within a second wall forming the pressure side of the airfoil portion.

18 Claims, 4 Drawing Sheets

INTEGRATED PLATFORM, TIP, AND MAIN BODY MICROCIRCUITS FOR TURBINE BLADES

BACKGROUND (1) Field of the Invention

The present invention relates to a turbine engine component having an integrated system for cooling the platform, the tip, and the main body of an airfoil portion of the component.

(2) Prior Art

FIG. 1 depicts an engine arrangement 10 illustrating the relative location of a high pressure turbine blade 12. FIGS. 2 and 3 depict the main design characteristics of a typical conventionally cooled high-pressure blade 12. In general, cooling flow passes through these blades by means of internal cooling channels 14 that are turbulated with trip strips 16 for enhancing heat transfer inside the blade. The cooling effectiveness of these blades is around 0.50 with a convective efficiency of around 0.40. It should be noted that cooling effectiveness is a dimensionless ratio of metal temperature ranging from zero to unity as the minimum and maximum values. The convective efficiency is also a dimensionless ratio and denotes the ability for heat pick-up by the coolant, with zero and unity denoting no heat pick-up and maximum heat pick-up respectively. The higher these two dimensionless parameters become, the lower the parasitic coolant flow required to cool the high-pressure blade. In other words, if the relative gas peak temperature increases from 2500 degrees Fahrenheit to 2850 degrees Fahrenheit, the blade cooling flow should not increase and if possible, even decrease for turbine efficiency improvements. That objective is extremely difficult to achieve with current cooling technology which is shown schematically in FIGS. 2 and 3. In general, for such an increase in gas temperature, the cooling flow would have to increase more than 5% of the engine core flow. The metal temperature in the embodiment of FIG. 3 is about 2180 degrees Fahrenheit. This level of temperature is considered above the target limit.

SUMMARY OF THE INVENTION

To improve the cooling effectiveness and the convective efficiency, several approaches are required. First, coating the airfoil with a thermal barrier coating is a first requirement. The other requirements are: (1) improved film cooling in terms of slots for increased film coverage; (2) improved heat pick-up; and (3) improved heat transfer coefficients in the blade cooling passages. With that in mind, the overall cooling effectiveness will approach 0.8 with a convective efficiency approaching 0.5, allowing for a lower cooling flow of no more than 3.5% of the engine core flow.

In accordance with the present invention, a turbine engine component having an airfoil portion with a pressure side and a suction side is provided. The turbine engine component broadly comprises means for cooling the suction side of the airfoil portion, which cooling means comprises a first cooling microcircuit embedded within a first wall forming the suction side. The first cooling microcircuit has means for allowing a cooling fluid in the first cooling microcircuit to exit at a tip of the airfoil portion. The turbine engine component further has a second cooling microcircuit in the pressure side of the airfoil portion and integrated means for cooling a platform portion of the turbine engine component.

Other details of the integrated platform, tip, and main body microcircuits for blades, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
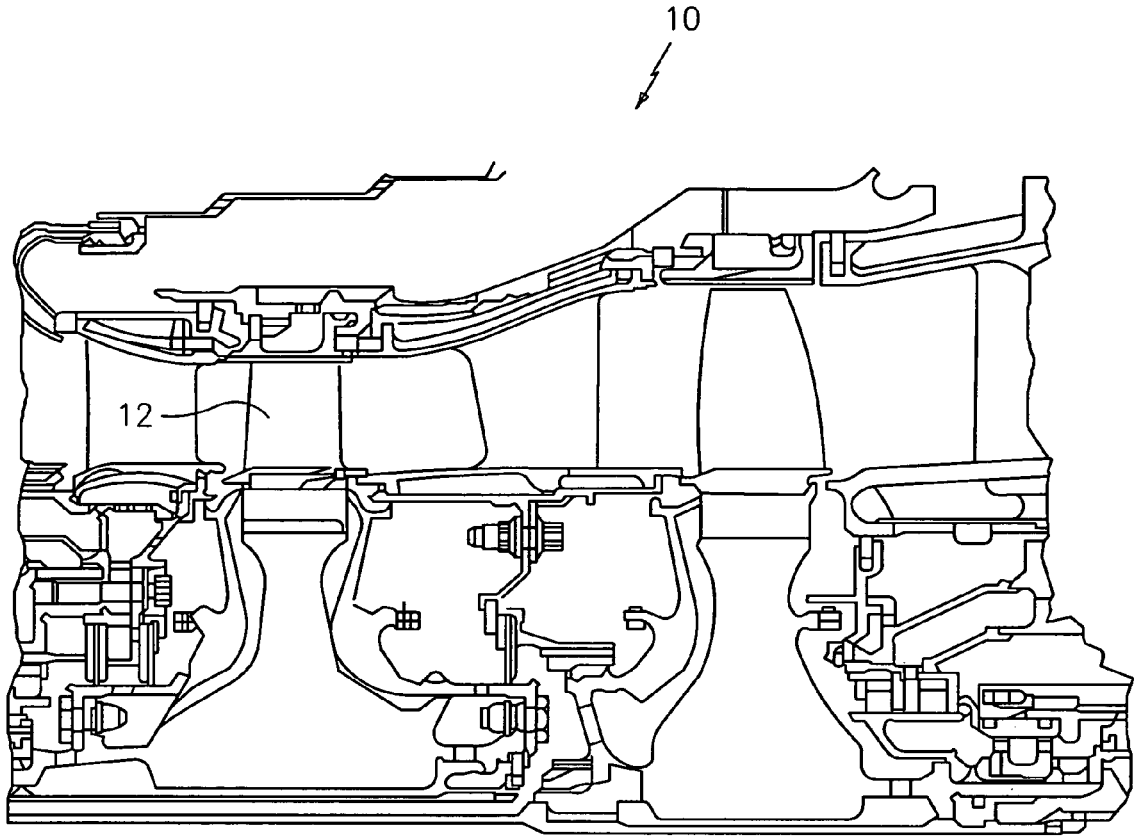
FIG. 1 is a schematic representation of a general high pressure turbine section of an engine.
Figure 2:
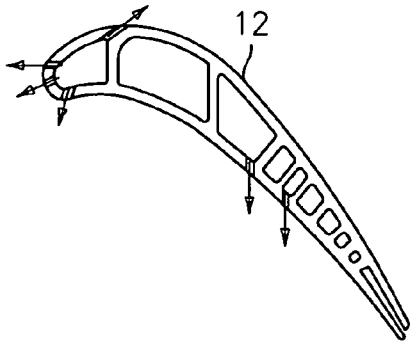
FIG. 2 is a sectional view of an airfoil portion of a turbine engine component showing existing design characteristics.
Figure 3:
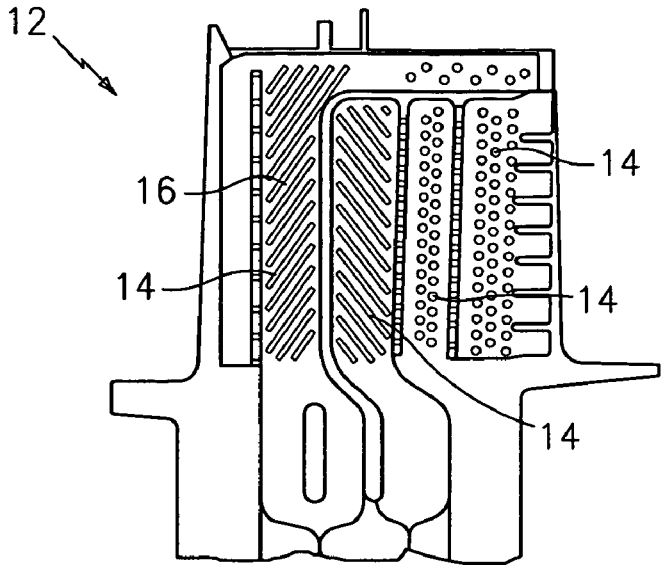
FIG. 3 is another sectional view of the airfoil portion of FIG. 2.
Figure 4:
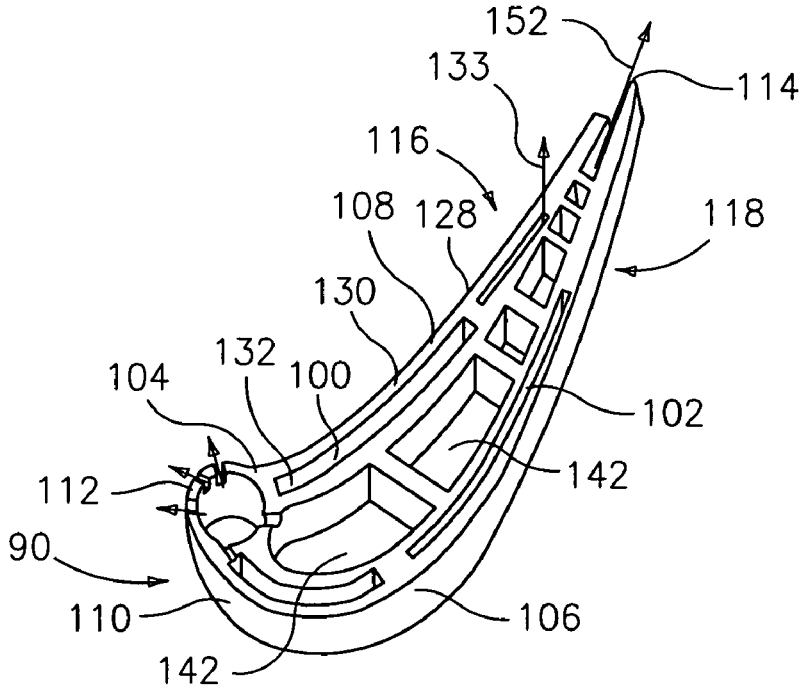
FIG. 4 is a sectional view of an airfoil portion of a turbine engine component having cooling microcircuits in accordance with the present invention.

As noted above, to improve the cooling effectiveness and the convective efficiency, several approaches are required. First, coating the airfoil with a thermal barrier coating is a first requirement. The other requirements are: (1) improved film cooling in terms of slots for increased film coverage; (2) improved heat pick-up; and (3) improved heat transfer coefficients in the blade cooling passages. With that in mind, the overall cooling effectiveness will approach 0.8 with a convective efficiency approaching 0.5, allowing for lower cooling flow of no more than 3.5%. One such design is shown in FIG. 4.

Figure 5:
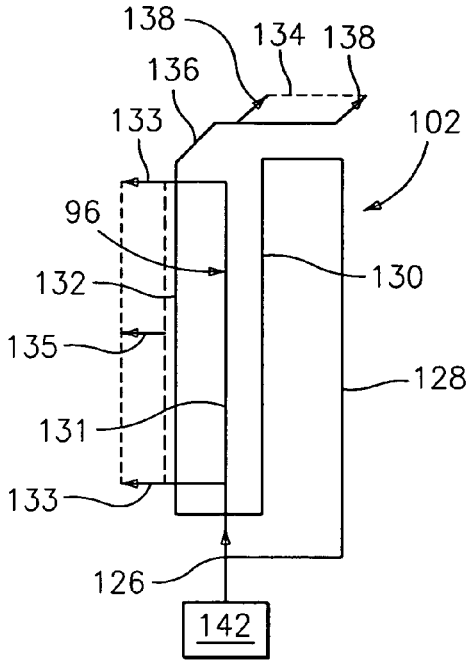
FIG. 5 is a schematic representation of the cooling microcircuit in the suction side of the airfoil portion.
Figure 6:
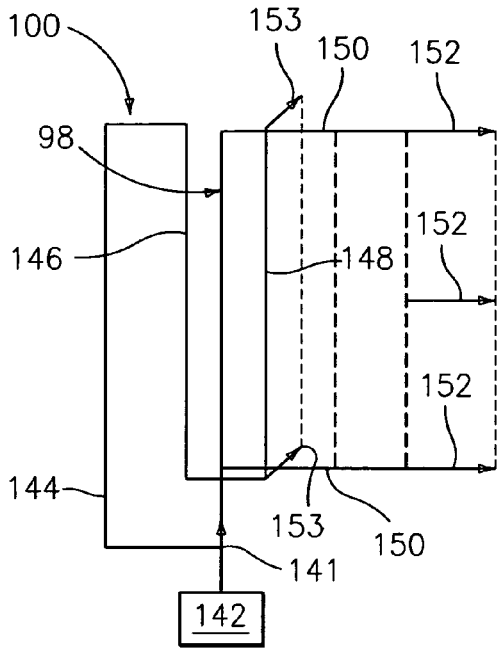
FIG. 6 is a schematic representation of the cooling microcircuit in the pressure side of the airfoil portion.

Referring now to the drawings, a turbine engine component 90, such as a high pressure turbine blade, is cooled using the cooling design scheme of the present invention. The cooling design scheme, as shown in FIG. 4, encompasses two serpentine microcircuits 100 and 102 located peripherally in the airfoil walls 104 and 106 respectively for cooling the main body 108 of the airfoil portion 110 of the turbine engine component. Separate cooling microcircuits 96 and 98, as shown in FIGS. 5 and 6, may be used to cool the leading and trailing edges 112 and 114 respectively of the airfoil main body 108. One of the benefits of the approach of the present invention is that the coolant inside the turbine engine component may be used to feed the leading and trailing edge regions 112 and 114. This is preferably done by isolating the microcircuits 96 and 98 from the external thermal load from either the pressure side 116 or the suction side 118 of the airfoil portion 110. In this way, both impingement jets before the leading and trailing edges become very effective. In the leading and trailing edge cooling microcircuits 96 and 98 respectively, the coolant may be ejected out of the turbine engine component by means of film cooling.

Referring now to FIG. 5, there is shown a serpentine cooling microcircuit 102 that may be used on the suction side 118 of the turbine engine component. As can be seen from this figure, the microcircuit 102 has a fluid inlet 126 for supplying cooling fluid to a first leg 128. The inlet 126 receives the cooling fluid from one of the feed cavities 142 in the turbine engine component. Fluid flowing through the first leg 128 travels to an intermediate leg 130 and from there to an outlet leg 132. Fluid supplied by one of the feed cavities 142 may also be introduced into the cooling microcircuit 96 and used to cool the leading edge 112 of the airfoil portion 110. The cooling microcircuit 96 may include fluid passageway 131 having fluid outlets 133. Still further, if desired, fluid from the outlet leg 132 may be used to cool the leading edge 112 via an outlet passage 135. As can be seen, the thermal load to the turbine engine component may not require film cooling from each of the legs that form the serpentine peripheral cooling microcircuit 102. In such an event, the flow of cooling fluid may be allowed to exit from the outlet leg 132 at the tip 134 by means of film blowing from the pressure side 116 to the suction side 118 of the turbine engine component. As shown in FIG. 5, the outlet leg 132 may communicate with a passageway 136 in the tip 134 having fluid outlets 138.

Referring now to FIG. 6, there is shown the serpentine cooling microcircuit 100 for the pressure side 116 of the airfoil portion 110. As can be seen from this figure, the microcircuit 100 has an inlet 141 which communicates with one of the feed cavities 142 and a first leg 144 which receives cooling fluid from the inlet 141. The cooling fluid in the first leg 144 flows through the intermediate leg 146 and through the outlet leg 148. As can be seen, from this figure, fluid from the feed cavity 142 may also be supplied to the trailing edge cooling microcircuit 98. The cooling microcircuit 98 may have a plurality of fluid passageways 150 which have outlets 152 for distributing cooling fluid over the trailing edge 114 of the airfoil portion 110. The outlet leg 148 may have one or more fluid outlets 153 for supplying a film of cooling fluid over the pressure side 116 of the airfoil portion 110 in the region of the trailing edge 114.

It should be noted that the cooling microcircuit scheme of FIGS. 4-6 is completely different from existing designs where a dedicated cooling passage, denoted as a tip flag is employed for cooling the tip 134.

Also as shown in FIGS. 4-6, the pressure side 116 of the airfoil main body 108 is cooled with a serpentine microcircuit 100 located peripherally in the airfoil wall 104. In this case, a flow exits in a series of film cooling slots 153 close to the aft side of the airfoil 110 to protect the airfoil trailing edge 114.

If desired, each leg 128, 130, 132, 144, 146, and 148 of the serpentine cooling microcircuits 100 and 102 may be provided with one or more internal features (not shown), such as pedestals and/or trip strips, to enhance the heat pick-up and increase the heat transfer coefficients characteristics inside the cooling blade passage(s).

Figure 7:
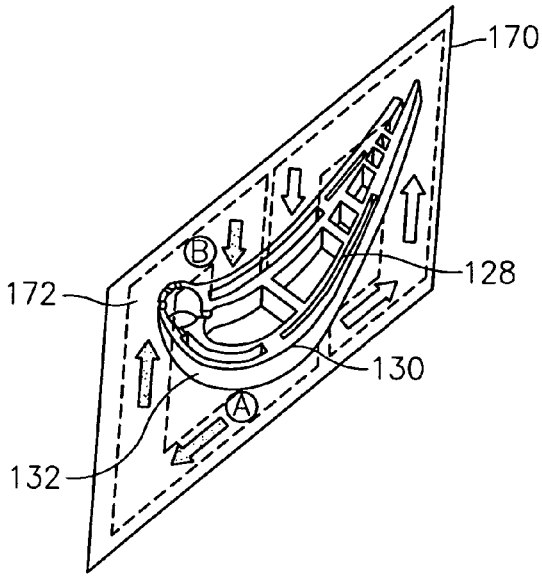
FIG. 7 is a schematic representation of an airfoil suction side and forward platform microcircuit cooling.
Figure 8:
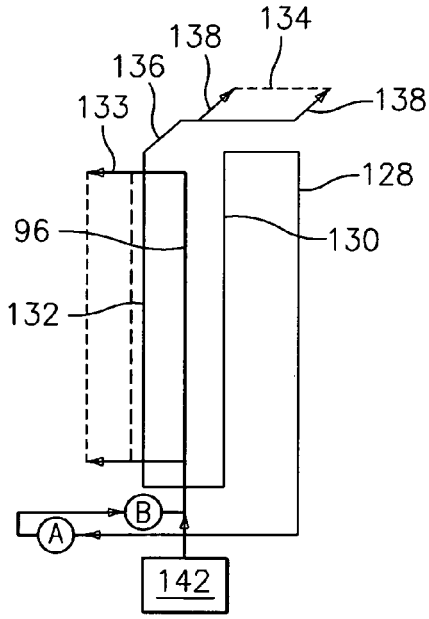
FIG. 8 is a schematic representation of the microcircuit cooling in FIG. 7.

Referring now to FIGS. 7 and 8, cooling microcircuits may be located around and imbedded in a platform portion 170 of the turbine blade. The cooling microcircuits may include a leading edge or forward cooling microcircuit 172 having an inlet portion A and an outlet portion B. As shown in FIG. 8, the inlet portion A may receive fluid from one of the feed cavities 142. Fluid from the outlet portion B flows back into the cooling microcircuit 96.

Figure 9:
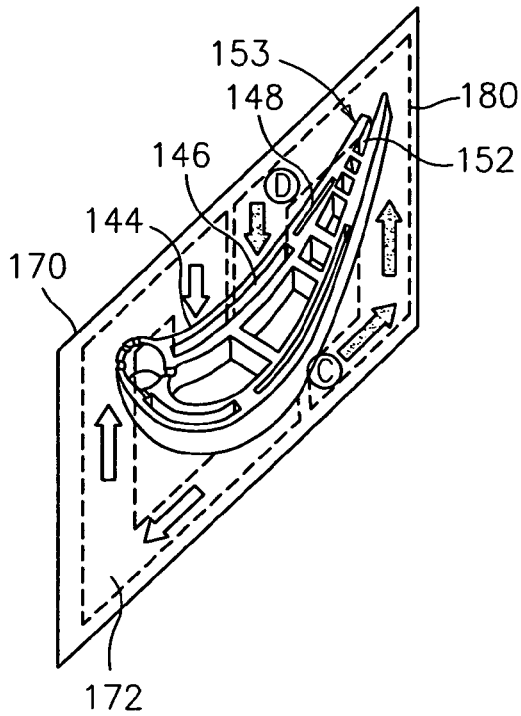
FIG. 9 is a schematic representation of the cooling microcircuit in a pressure side of the airfoil portion and aft platform microcircuit cooling.
Figure 10:
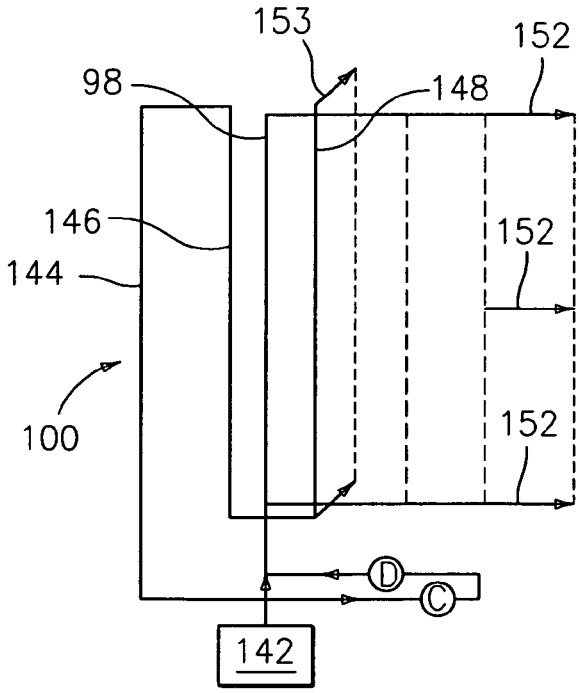
FIG. 10 is a schematic representation of the microcircuit cooling in FIG. 9

Referring now to FIGS. 9 and 10, the platform cooling microcircuits may include a trailing edge or aft cooling microcircuit 180 having an inlet portion C and an outlet portion D. The inlet portion C may receive fluid from one of the feed cavities 142. Fluid from the outlet portion D flows into the cooling microcircuit 98.

As can be seen, the platform cooling is independent of the serpentine cooling microcircuits 100 and 102 used for the airfoil portion 100. The inlet coolant flow to either of the leading and trailing edge cooling microcircuits 172 and 180 comes from a lower radii. This coolant flow is allowed to pass through the platform walls before discharging into the cooling microcircuit 96 or 98 at a higher radii. The rotational pumping which is created, along with the ejector-type action of the main flow, will ensure circulation in the peripheral platform cooling microcircuits 172 and 180. In this way, an integrated cooling system has been devised to cool the platform 170, the main body 108 of the airfoil portion 110, and the tip 134 of the airfoil portion 110 by taking advantage of the microcircuit cooling characteristics.

If desired, the platform cooling microcircuits 172 and 180 may be provided with one or more internal features (not shown), such as pedestals, to enhance heat pick-up and increase the heat transfer coefficient characteristics inside the cooling passage(s) of the cooling microcircuits.

It is apparent that there has been provided in accordance with the present invention an integrated platform, tip, and main body microcircuits for engine blades which fully satisfies the objects, means, and advantages set forth hereinbefore. While the present invention has been described in the context of specific embodiments thereof, other unforeseeable alternatives, modifications, and variations may become apparent to those skilled in the art having read the foregoing detailed description. Accordingly, it is intended to embrace those alternatives, modifications, and variations as fall within the broad scope of the appended claims.

What is claimed is:

1. A turbine engine component having an airfoil portion with a pressure side and a suction side comprising:

means for cooling said suction side of said airfoil portion;

said cooling means comprising a first cooling microcircuit embedded within a first wall forming said suction side; and said first cooling microcircuit having means for allowing a cooling fluid in said first cooling microcircuit to exit at a tip of said airfoil portion, wherein said cooling fluid exits at said tip by means of film blowing from the pressure side to the suction side of the airfoil portion.

2. The turbine engine component according to claim 1, wherein said first cooling microcircuit has a serpentine arrangement.

3. The turbine engine component according to claim 1, further comprising a second cooling microcircuit embedded within a second wall forming said pressure side of said airfoil portion.

4. The turbine engine component according to claim 3, wherein said second cooling microcircuit has a serpentine arrangement.

5. The turbine engine component according to claim 3, further comprising means for creating a flow of cooling fluid over a trailing edge of said airfoil portion.

6. The turbine engine component according to claim 5, wherein said means for creating a flow of cooling fluid over a trailing edge of said airfoil portion is isolated from an external thermal load from either the pressure side or the suction side of the airfoil portion.

7. The turbine engine component according to claim 5, wherein said means for creating a flow of cooling fluid over said leading edge of said airfoil portion is isolated from an external thermal load from either the pressure side or the suction side of the airfoil portion.

8. The turbine engine component according to claim 3, further comprising means for creating a flow of cooling fluid over a leading edge of said airfoil portion.

9. The turbine engine component according to claim 3, further comprising a platform and means for cooling said platform.

10. The turbine engine component according to claim 9, wherein said platform cooling means comprises a third cooling microcircuit embedded within a forward portion of said platform.

11. The turbine engine component according to claim 10, wherein said platform cooling means further comprises a fourth cooling microcircuit embedded within an aft portion of said platform.

12. The turbine engine component according to claim 11, wherein each of said third and fourth cooling microcircuits has an inlet at a first level and an outlet at a second level different from said first level.

13. The turbine engine component according to claim 12, wherein said first level is lower than said second level.

14. The turbine engine component according to claim 3, wherein said platform cooling means is independent of said first and second cooling microcircuits.

15. The turbine engine component according to claim 1, wherein said component comprises a blade.

16. The turbine engine component according to claim 1, wherein said component comprises a high-pressure blade.

17. A turbine engine component having an airfoil portion with a pressure side and a suction side comprising:

means for cooling said suction side of said airfoil portion;

said cooling means comprising a first cooling microcircuit embedded within a first wall forming said suction side;

said first cooling microcircuit having means for allowing a cooling fluid in said first cooling microcircuit to exit at a tip of said airfoil portion; and a second cooling microcircuit embedded within a second wall forming said pressure side of said airfoil portion, wherein said second cooling microcircuit has an inlet and a plurality of film cooling slots close to an aft side of the airfoil portion through which cooling fluid flowing through said second cooling microcircuit exits.

18. The turbine engine component according to claim 17, wherein said cooling fluid exits at said tip by means of film blowing from the pressure side to the suction side of the airfoil portion.

* * * * *